US006267558B1

(12) United States Patent
Dingwell et al.

(10) Patent No.: US 6,267,558 B1
(45) Date of Patent: Jul. 31, 2001

(54) DUAL INTENSITY PEENING AND ALUMINUM-BRONZE WEAR COATING SURFACE ENHANCEMENT

(75) Inventors: William T. Dingwell, West Chester; Andrew J. Lammas, Maineville; Herbert Halila, Cincinnati, all of OH (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/318,641

(22) Filed: May 26, 1999

(51) Int. Cl.[7] ..... B63H 1/20
(52) U.S. Cl. ..... 416/219 R; 416/241 R
(58) Field of Search ..... 416/219 R, 224 R, 416/220 R, 229 A, 241 R, 248, 239; 428/660, 674, 610, 937; 148/669, 670, 537, 421, 902

(56) References Cited

U.S. PATENT DOCUMENTS

| | | | | |
|---|---|---|---|---|
| 5,141,401 | | 8/1992 | Juenger et al. | 416/219 R |
| 5,160,243 | * | 11/1992 | Herzner et al. | 416/220 R |
| 5,356,545 | | 10/1994 | Wayte | 252/28 |
| 5,476,363 | * | 12/1995 | Freling et al. | 415/173.1 |
| 5,562,999 | * | 10/1996 | Grunke et al. | 428/651 |
| 5,620,307 | * | 4/1997 | Mannava et al. | 416/241 R |
| 5,771,729 | * | 6/1998 | Bailey et al. | 72/53 |
| 6,089,828 | | 7/2000 | Hollis et al. | 416/219 R |

* cited by examiner

*Primary Examiner*—Edward K. Look
*Assistant Examiner*—Hermes Rodriguez
(74) *Attorney, Agent, or Firm*—Andrew C. Hess; David L. Narciso

(57) ABSTRACT

An article and a method for improving an article that results in a reduction or elimination of damage due to fretting from contact of similar metals. The invention specifically reduces wear-related fretting between titanium alloy parts by lowering the stresses between mating parts. An aluminum bronze coating is applied to one of the parts. The aluminum bronze coating provides an improvement over prior art coatings in reducing coefficient of friction between the parts. Additionally, the cumulative stresses at the surface of the parts is reduced by a dual intensity peening treatment. This involves a first peening operation using large peening media that provides a compressive stress to the required depth. This first peening operation is followed by a second peening operation that provides additional compressive stresses closer to the dovetail surface. The combined metallurgical and mechanical improvement results in a system with less susceptibility to fretting damage and corresponding improved fatigue resistance.

20 Claims, 2 Drawing Sheets

DUAL INTENSITY PEENING AND ALUMINUM-BRONZE WEAR COATING SURFACE ENHANCEMENT

BACKGROUND OF THE NVENTION

1. Field of the Invention

This invention relates generally to reduction in fretting between blades and disks in turbine engines, and specifically to reduction in fretting between titanium and titanium alloy compressor blade dovetails and titanium and titanium alloy compressor disks in the high pressure compressor portions of turbine engines.

2. Discussion of the Prior Art

Titanium and titanium alloys are used in the portion of aircraft engines to the fore or front portion of the engine because of their excellent mechanical properties, such as excellent strength, low density and favorable mechanical properties. However, the blades and the disks are usually separate parts that are fretted together, except in certain situations in which a blisk is used. The one disadvantage of separate titanium blades and titanium disks is that they rub against each other at the blade-to-disk attachment contact surfaces.

When two pieces of metallic material rub or slide against each other, frictional forces between the parts may result in damage to materials through the generation of heat, or through a variety of fatigue processes generally termed fretting or galling.

In certain aircraft engine designs, a titanium or titanium alloy compressor disk, also referred to as a compressor rotor, has an array of dovetail slots arranged around its outer periphery The compressor blades, also made of titanium or titanium alloy have corresponding dovetail bases to allow mate-up of the blade dovetail bases with the respective rotor dovetail slots so that the blade is retained within the dovetail slots. When the rotor is operating at normal operating speeds, centrifugal force causes the blades to move radially outward. The sides of the blade dovetail slide against the sides of the rotor slots.

Various approaches to solve the problem have been attempted in the region to reduce the damage due to fretting, with limited success. Copper-nickel-indium coating has been applied to the blade dovetail. While the coating has lowered the coefficient of friction between the blade dovetail and rotor dovetail slot, the reduction is not sufficient to eliminate fretting. Furthermore, once the coating wears off, in a few thousand cycles of engine operation, fretting once again becomes a problem.

Another solution to the problem has been to apply a dry film lubricant to the region between the blade dovetail and the rotor dovetail slot, such as is described in U.S. Pat. No. 5,356,545 assigned to the assignee of the present invention. While this invention has delayed the onset of fretting, it has not solved the problem. The dry film lubricant is displaced after about 2000 cycles or less of engine operation, and the normal processes leading to fretting occur after its loss.

Another solution has been to modify the area of highest stresses between the rotor dovetail slot and blade dovetail by undercutting the slot dovetail in the disk to remove disk material in the area where surface peak stressing (edge of contact) would otherwise occur, such as is described in U.S. Pat. No. 5,141,401, assigned to the assignee of the present invention. Once again, this solution has had varying amounts of success in reducing the time to crack initiation resulting from low cycle fatigue in that it is effective only while the wear does not approach the depth of the undercut, which in turn is limited by the dovetail size.

Despite all of the attempts to eliminate fretting, cracking resulting from such fretting continues to occur in high pressure compressor blade dovetails. Cracking has been observed on stage 3, 4 and 5 high pressure compressor blade dovetails at the upper edge of contact between the blades and the disk. The cracking occurs in engines that have experienced at least 4000 engine cycles, which corresponds to approximately 12,000 hours of engine operation. The problem to be solved is one of eliminating cracks induced by the forces generated between the dovetail of the blade and the dovetail slot of the rotor disk, thereby extending the operating life of the blades and hence the compressor assemblies.

What is needed is a new approach to reduce the fretting while simultaneously neutralizing degradation, thereby eliminating the onset of cracking so that engine life is not impacted by compressor problems in this area.

SUMMARY OF THE INVENTION

The present invention provides a novel approach which combines a reduction in damage from fretting with the ability to also better resist fretting as a result of contact between the blade dovetail and the rotor dovetail slot. Furthermore, the present invention may be used in conjunction with existing approaches that extend the time until the onset of fretting, such as dry film lubricants and mechanical modifications to reduce regions of stress concentrations.

Specifically, the present invention utilizes a combination of a metallurgical solution, an application of aluminum-bronze coating in conjunction with a mechanical solution application of a dual intensity peening treatment.

The blade dovetail is first subjected to a dual intensity peening treatment. This involves a first peening operation of high intensity using large peening media that provides a compressive stress to the required depth. This first peening operation is followed by a second conventional peening operation of lower intensity using conventional peening media that provides both additional compressive stresses closer to the dovetail surface and a smoother surface.

After the part has undergone the dual intensity peeing operation, it is then coated with an aluminum bronze coating to a preselected thickness. The aluminum bronze coating reduces the coefficient of friction between the disk and the blade. The lower coefficient of friction results in lower forces between the blade and the dovetail which in turn translates into a longer life. The blade can then be installed in the rotor dovetail using commonly used installation practices. Typically, this involves use of a dry film lubricant that further assists in reducing friction.

The advantages of the present invention is that it can be used in combination with other standard installation practices utilized to extend the life of compressor blades and also to increase the mean time between required inspections.

Another advantage is that the surface modifications to the compressor blades do not require significant machining operations of the blade or redesign of the blade or rotor assembly. The aluminum bronze dovetail coating provides a lower friction coefficient while the dual intensity peening provides an effective residual compressive stress.

Finally, the combination of dual intensity peening and aluminum bronze coating improves the durability of the interface between the blade and the disk to reduce or eliminate blade dovetail failures at the edge of contact between the blade and the rotor dovetail slot within the required life without removal from the engine.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

In the various figures and drawings, like reference characters designate like parts and features.

DETAILED DESCRIPTION OF THE INVENTION

Figure 1:
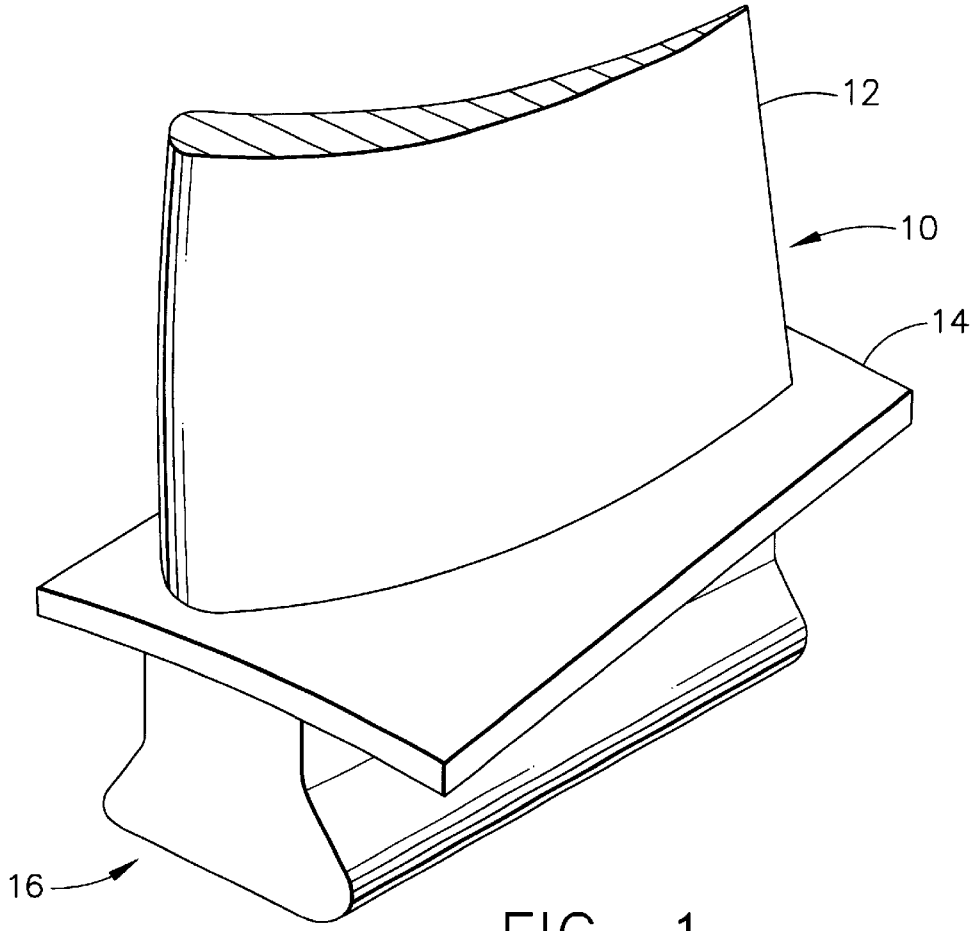
FIG. 1 is perspective view of a typical compressor blade.

The present invention extends the life of titanium and titanium alloy compressor blades used in the compressor section of an aircraft gas turbine engine. FIG. 1 is a perspective view of a typical compressor blade 10 used in the compressor section of a gas turbine. The blade depicted is a cantilevered blade having an axial dovetail. Blade 10 is comprised of an airfoil 12 that extends outward into the airflow from a metal platform 14. Extending inward from platform 14 is blade dovetail 16. It is understood by those skilled in the art that compressor blades may include various modifications to vary performance in specific applications, such as tip shrouds, cantilevered circumferential dovetails and part span shrouds. Nevertheless, most compressor blade designs include these fundamental features.

Figure 2:
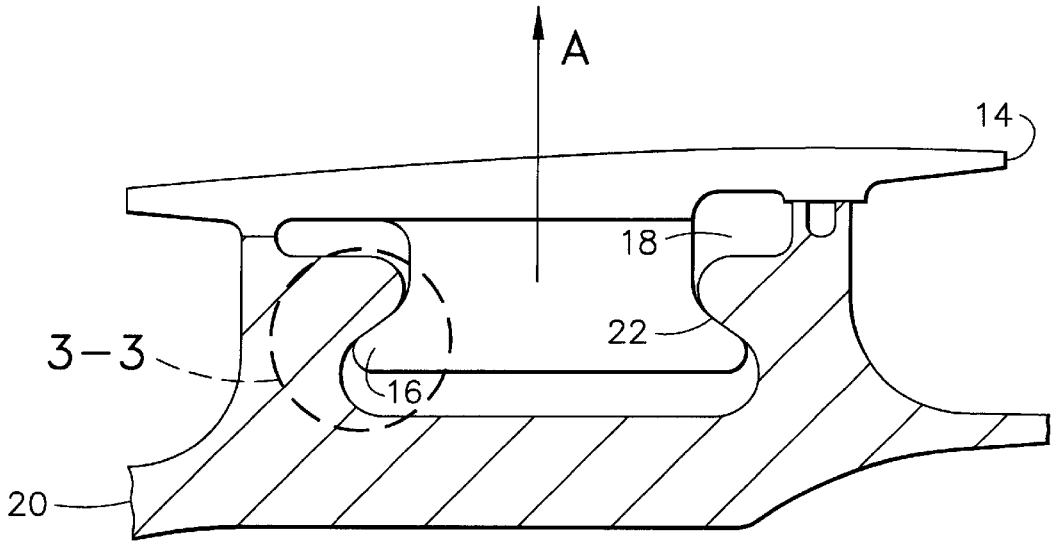
FIG. 2 is a cross-sectional view of a compressor blade installed within a dovetail slot of a typical rotor disk, during engine operation.

FIG. 2 depicts a blade dovetail assembled into the dovetail slot 18 of a rotor or disk assembly 20. Each rotor or disk contains a plurality of rotor slots around its periphery to receive a plurality of compressor blades. Furthermore, a typical aircraft gas turbine engine contains a plurality of compressor stages comprised of compressor blades assembled to rotors, each successive stage having an increasing number of smaller blades assembled to the rotor disk.

As the compressor rotates at high speeds, blade dovetail 16 moves outwardly as a result of centrifugal force in the direction A as shown in FIG. 2. The motion causes resulting contact between the blade dovetail 16 and the rotor dovetail slot along a region of contact 22. In addition to the outward forces due to the continued effect of centrifugal force, there is also continued rubbing as a result of engine vibration and airflow dynamics as the compressor disk rotates.

Failure analysis has determined that cracks have initiated in the rotor dovetail along the region of contact and have propagated into the blade. Although the crack initiation and propagation procedure is complex, it is believed that the cracking is originated by low cycle fatigue and is propagated by high cycle fatigue. This cracking entails costly downtime and periodic inspections in order to detect and remove cracked blades before a failure occurs. Although various techniques are used to reduce friction in this critical area and have been effective in improving mean life before onset of cracking, the improvements have not been sufficient. As noted above, dry film lubricants are applied to reduce the friction to prevent the onset of fretting. However, the dry film lubricants eventually dissipate after as much as a few thousand cycles due to a number of factors. With the loss of this protective mechanism, fretting and its consequences can once again develop. Copper-nickel-indium coatings applied to the dovetails to reduce the coefficient of friction in region of contact 22 also are sacrificial.

Figure 3:
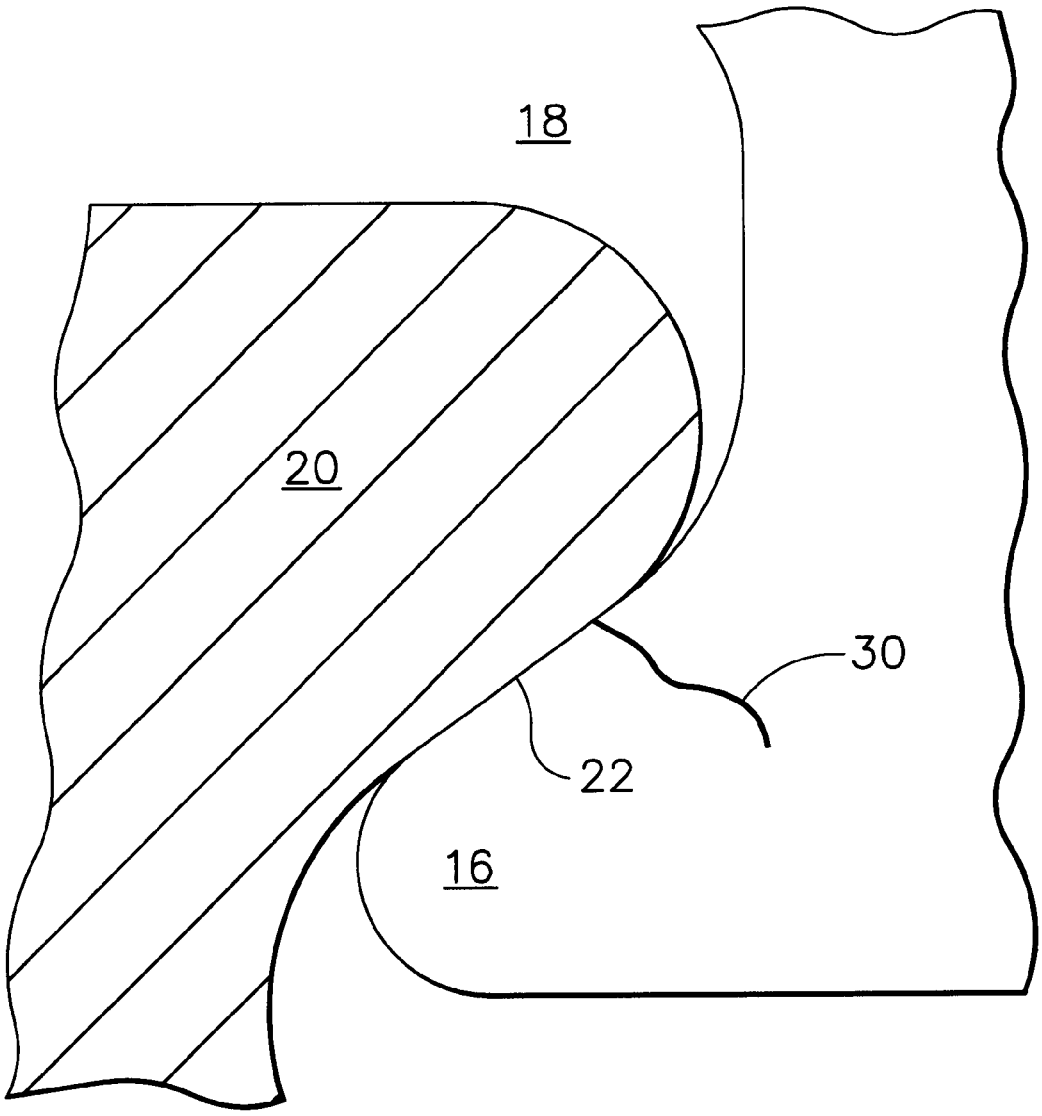
FIG. 3 is an exploded view of the contact region between the blade dovetail and the rotor dovetail slot.

The present invention helps to increase the life expectancy of the blade dovetails by modifying the processes involved in both the initiation of cracking and in the propagation of the initiated cracks. Low cycle fatigue is caused by high stresses that occur over a limited number of cycles. In this case, the high stresses occur in the surface along region of contact 22. As indicated in FIG. 3, the region of contact exhibits high stresses as a result of rubbing between the wall of the dovetail slot on the rotor and the wall of the blade dovetail. Cracking has typically been observed to occur in this region, as indicted by crack 30. Not coincidentally, this region is also the location of maximum stress during operation. Low cycle fatigue is caused by repeated application of a relatively low number of cycles of relatively high stresses, while high cycle fatigue is caused by a repeated application of a relatively high number of cycles of relatively low stresses arising form normal vibration of the blade. Because fatigue is caused by continued application of cyclic forces, solutions to fatigue include reducing the stresses below critical values or reducing the cycles. If the stresses cannot be lowered below critical values, the onset of fatigue can be delayed by reducing the absolute value of the applied stresses. In gas turbine applications, the general operation of the engine involves cyclic operation and the trend is to increase the number of cycles of operation. Therefore, the improvements or solutions to the problem of fatigue are to be found by modifying the applied stresses combined with reducing the fatigue degradation due to wear/fretting.

As noted above, the mechanism for failure is crack initiation and crack propagation. It appears that crack initiation is induced by low cycle fatigue, while crack propagation is accelerated by high cycle fatigue. The present invention delays the onset of crack initiation by applying an aluminum bronze coating to the blade dovetail. This aluminum bronze is applied in addition to the standard application of dry film lubricants. Once the dry film lubricants have been dissipated over the first few thousand cycles of operation, the aluminum bronze, applied as a coating on the blade dovetail, serves to reduce friction between the structural portion of the blade, comprised of titanium or titanium alloys, and the titanium-based rotor. Although other coatings have been used in this location for essentially the same purpose, such as Cu—Ni—In coatings, aluminum bronze coating provides a superior coating because it produces a lower coefficient of friction with the titanium based rotor assembly. Because the applied force and corresponding stress is proportionate to coefficient of friction, the aluminum bronze serves the purpose of reducing the stresses in the region of contact. However, like the dry film lubricant, the aluminum bronze is sacrificial, and will delay the onset of fretting only as long as it remains present. Nevertheless, because it has a lower coefficient of friction, it should be operational over more cycles than other coatings.

Aluminum bronze generically refers to copper based alloys having an aluminum content in the range of about 9 to about 12% by weight of aluminum, up to about 6% by weight of Fe and Ni and combinations thereof, impurities up to about 1%, with the balance being copper. In the preferred embodiment, used as a coating in the present invention, the composition includes about 9 to about 11% by weight Al, about 0.7 to about 1.5% by weight Fe and the balance Cu and incidental impurities. Preferably, the incidental impurities to not exceed 0.5%. The aluminum bronze is applied to the blade dovetail to a thickness of from 0.001 to about 0.007 inches, and preferably to a thickness of about 0.003 to about 0.005 inches. Although the aluminum bronze material may be applied as a coating by any conventional method, flame spraying has been found to produce a uniform coating, and is a relatively inexpensive technique.

While the aluminum bronze provides the benefit of reduced friction, since it is sacrificial, like the applied dry film lubricant, its benefits disappear after it wears away. Thus, to provide additional protection in this region, the dovetail portion of the blade is mechanically modified so that it can endure the stresses in this region after the aluminum bronze coating has been sacrificed. This is accomplished by peening the surface of the blade in the dovetail. The dual peening results in a residual compressive stress layer in the surface region of the blade. Thus, when the blade dovetail contacts the rotor wall in the region of contact 22, although the applied load is the same, the region of contact has a lower resultant stress due to the presence of the residual compressive stress layer. This is because the applied stresses are additive. The residual compressive stress in the surface region of the dovetail after the peening operation is an opposite or opposed stress to the tensile stress caused during engine operation. Relatively speaking, if the tensile stress caused by engine operation is positive, then the residual compressive stress from the peening operation is negative. The cumulative effect of the residual compressive stresses and the applied stresses due to engine operation is a lower resultant stress, which, as discussed above, acts to at least delay the onset of crack initiation.

The desired compressive stress in the surface should extend to the maximum extent possible in order to maximize the wear/fretting depth protection, and the operation that produces such a stress should not itself inflict damage to the surface. A method referred to as dual intensity peening has been found to produce such a desirable compressive stress. The article, in this case the dovetail of the blade, is first subjected to a peening operation with first particles of a first size. This produces a compressive stress to a first desired depth. Then, the article in peened a second time with second particles having a second size smaller that the first particles. The second particles act to smooth out the surface of the article, which may have been somewhat roughened by the first peening operation and prevent the development of minute surface damage. The second peening operation also produces additional compressive stresses, but these compressive stresses are do not extend as deeply as those produced by the first operation. Thus, the article peened by the dual intensity peening operation has a complex residual stress pattern that reaches a peak at or near the surface.

The preferred method for applying a compressive stress to blade dovetails using the dual intensity peening operation is to first expose the dovetail region to a first cut wire having a first diameter of about 0.023" nominal. Using the standard measurement techniques, this peening operation produces a strip measurement intensity of about 0.013–0.017 on the Almen "A" scale. The dovetail is then peened using a second cut wire having nominal diameter of about 0.014 inches. This peening operation produces a strip measurement intensity of about 0.005–0.009 inches on the Almen "A" scale. The cumulative peening operations provide compressive stresses that extend to a depth of about 0.008 to about 0.010 inches on the Almen "A" scale, after peening. Furthermore, the stresses from the multiple peening operations are not uniform, as the highest compressive stresses occur at or very near the blade dovetail surface. While friction between the blade dovetail and the walls of the dovetail slot in the rotor will increase after loss of the sacrificial coating, the overall stresses will be reduced due to the presence of the compressive layer, thereby extending the life of the blade by further delaying the inception of cracking, as well as slowing the crack propagation process. While wire of the specified diameter was used, any shot peening media that can produce the same results may be used.

While the constant rubbing between the blade dovetail and the walls of the rotor at the dovetail slot will eventually result in the loss of the sacrificial coating and in the wearing away of the compressive region located along the surface of the blade dovetail, the reduced friction of a sacrificial aluminum bronze coating and the reduction in resultant stress due to the dual peening operation will delay the onset of fatigue induced cracking in the blade dovetails. If such a delay extends the life of the dovetails beyond the expected life of the engine, the fatigue cracking will have effectively been eliminated.

Testing was performed on blades made in accordance with the present invention, that is to say, the blades were peened using the dual intensity peeing operation as set forth above and then provided with a coating of aluminum bronze having a coating applied to an average thickness in the range of 0.003–0.005 inches by flame spraying. These blades were compared with baseline blades coated with the well-known Cu—Ni—In wear protection coating and peened using a single low intensity peening process in which compressive stresses were imparted to a depth of about 0.006 inches nominal. Testing involved superimposing test cycles having a peak load LCF component with a superimposed HCF component. The test results are set forth in Table 1. The blades made in accordance with the present invention, test numbers 5–9 displayed an average life expectance increase, in terms of cycles to failure, of about 48% over the baseline blades, test numbers 1–4.

TABLE 1

| Test Number | LCF Cycles to Failure | HCF Cycles to Failure |
|---|---|---|
| 1 | 10,887 | 1,306,440 |
| 2 | 12,929 | 1,551,480 |
| 3 | 23,573 | 2,828,760 |
| 4 | 17,111 | 2,053,320 |
| 5 | 17,642 | 2,117,040 |
| 6 | 42,062 | 5,047,440 |
| 7 | 21,047 | 2,525,640 |
| 8 | 20,946 | 2,513,520 |
| 9 | 19,070 | 2,288,400 |

Although the present invention has been described in connection with specific examples and embodiments, those skilled in the art will recognize that the present invention is capable of other variations and modifications within its scope. These examples and embodiments are intended as typical of, rather than in any way limiting on, the scope of the present invention as presented in the appended claims.

What is claimed is:

1. A titanium-base alloy blade having improved resistance to fretting damage for use in the compressor portion of a gas turbine engine, the blade having a dovetail portion for insertion into a dovetail slot of a titanium-base alloy rotor, comprised of:

an outer surface portion having residual compressive stresses extending to a depth of at least about 0.008 inches below the surface, residual compressive stresses graded so that the stresses are reduced as the distance below the surface increases; and a metallurgical coating applied over the outer surface portion of the blade dovetail, the coating providing a reduced coefficient of friction to the outer surface portion of the blade dovetail when in contact with the rotor dovetail slot.

2. The blade of claim 1 wherein the residual compressive stresses result from a plurality of peening operations and extend to a depth of about 0.008–0.010 inches below the surface.

3. The blade of claim 1 wherein the residual compressive stresses are applied by first peening the blade dovetails using first particles having a first size, and the peening the blade dovetails using second particles having a second size smaller than the first size.

4. The blade of claim 1 wherein the metallurgical coating applied over the outer surface portion of the blade dovetail is a coating of aluminum bronze.

5. The blade of claim 4 wherein the aluminum bronze has a composition of from about 9–12% by weight Al, up to about 6% by weight of at least one element selected from the group consisting of Fe and Ni and combinations thereof, and the balance Cu and incidental impurities.

6. The blade of claim 5 wherein the aluminum bronze has a composition of about 9–11% by weight Al, about 0.7–1.5% by weight Fe, up to about 0.5% incidental impurities and the balance Cu.

7. A compressor assembly for a gas turbine engine having improved life, the compressor assembly comprised of:

a titanium-base alloy rotor having a plurality of dovetail slots positioned along its outer periphery for receiving the dovetail portions of blades;

a plurality of titanium-base alloy blades, each blade having at least an airfoil section and an opposed dovetail portion, the dovetail portion for insertion into the dovetail slots of the rotor, the dovetail portion of each blade having an outer surface portion having residual compressive stresses, and a metallurgical coating applied over the outer surface portion of the blade dovetail, the coating acting as a barrier between the titanium base alloy dovetail and the titanium base alloy rotor and providing a reduced coefficient of friction to the outer surface portion of the blade dovetail when in contact with the rotor dovetail slot.

8. The compressor assembly of claim 7 further including a dry film lubricant applied as a coating over the metallurgical coating to provide lubrication between the rotor dovetail slot and the metallurgical coating.

9. The compressor assembly of claim 8 wherein the residual compressive stresses extend to a depth of at least about 0.008–0.010 inches below the surface portion of the dovetail.

10. The compressor assembly of claim 9 wherein the residual compressive stresses are applied by first peening the blade dovetails using first particles having a first size, and the peening the blade dovetails using second particles having a second size smaller than the first size.

11. The compressor assembly of claim 8 wherein the metallurgical coating applied over the outer surface portion of the blade dovetail is a coating of aluminum bronze.

12. The compressor assembly of claim 11 wherein the aluminum bronze applied over the blade dovetail has a composition of from about 9–12% by weight Al, up to about 6% by weight of at least one element selected from the group consisting of Fe and Ni and combinations thereof, and the balance Cu and incidental impurities.

13. The compressor assembly of claim 12 wherein the aluminum bronze applied over the blade dovetail has a composition of about 9–11% by weight Al, about 0.7–1.5% by weight Fe, up to about 0.5% incidental impurities and the balance Cu.

14. A method for processing a titanium-base alloy compressor blade having an improved resistance to fretting damage for use in the compressor portion of a gas turbine engine, comprising the steps of:

peening the blade dovetails using first particles having a first size; then, peening the blade dovetails using second particles having a second size smaller than the first size; followed by applying a metallurgical coating over the outer surface portion of the blade dovetail, the metallurgical coating providing a reduced coefficient of friction to the outer surface portion of the blade dovetail when in contact with a corresponding rotor dovetail slot.

15. The method of claim 14 wherein the first particles are wires having a nominal diameter of about 0.023 inches.

16. The method of claim 15 wherein the second particles are wire having a nominal diameter of about 0.014 inches.

17. The method of claim 15 wherein the peening using first the first particles produces residual compressive stresses to a depth of at least about 0.008 inches.

18. The method of claim 14 wherein the metallurgical coating applied over the outer portion of the dovetail is comprised of aluminum bronze.

19. The method of claim 18 wherein the metallurgical coating has a composition of about 9–11% by weight Al, about 0.7–1.5% by weight Fe. up to about 0.5% incidental impurities and the balance Cu.

20. The method of claim 19 wherein the aluminum bronze coating is applied to the blade dovetail using flame spraying.

* * * * *